US006503057B1

(12) United States Patent
Tsui

(10) Patent No.: US 6,503,057 B1
(45) Date of Patent: Jan. 7, 2003

(54) SPIRAL FLUTED WHEEL FOR A WATER PUMP

(75) Inventor: Shu-Chen Tsui, Taichung Hsien (TW)

(73) Assignee: Sea-Chung Electric Co., Ltd., Taichung Hsien (TW)

( * ) Notice: Subject to any disclaimer, the term of this patent is extended or adjusted under 35 U.S.C. 154(b) by 0 days.

(21) Appl. No.: 09/911,803

(22) Filed: Jul. 25, 2001

(51) Int. Cl.[7] ..... F03D 11/00

(52) U.S. Cl. ..... 416/186 R; 416/223 B

(58) Field of Search ..... 416/186 R, 188, 416/223 B, 213 A, 214 R

(56) References Cited

U.S. PATENT DOCUMENTS 4,923,367 A * 5/1990 Zimmer ..... 415/199.1

* cited by examiner

*Primary Examiner*—F. Daniel Lopez
*Assistant Examiner*—James M McAleenan
(74) *Attorney, Agent, or Firm*—Jones, Tullar & Cooper, P.C.

(57) ABSTRACT

A spiral fluted wheel for a water pump is composed of a first plate (10), a second plate (20) corresponding to the first plate (10), and a plurality of spiral impellers (30) sandwiched between the first plate (10) and the second plate (20). Each spiral impeller (30) has planned complementary flanges so as to combine with adjacent spiral impellers (30) easily and precisely.

4 Claims, 5 Drawing Sheets

SPIRAL FLUTED WHEEL FOR A WATER PUMP

2 BACKGROUND OF THE INVENTION

1. Field of the Invention

The present invention relates to a spiral fluted wheel for a water pump, and more particularly to a spiral fluted wheel that can be produced rapidly and precisely.

2. Description of Related Art

Referring to FIGS. 3, and 4, a water pump with a conventional multiple vane case comprises a shell (50), multiple vane cases (51), multiple guide cases (52), a filter (53), a motor (54) with an electricity supply wire (55), and a water outlet pipe (56). The water pump is typically received in a well to draw water therefrom.

The shell (50) contains the multiple vane cases (51) and the multiple guide cases (52) in alternative with each other inside and the filter (53) is mounted under the shell (50) to filtrate water by its meshes. The motor (54) is secured under the filter (53) and has an axle tube (540) penetrating the multiple vane cases (51) and the multiple guide cases (52) and driving all cases (51, 52) to rotate. The water pipe (56) is communicated with the shell (50) to pump water out of the well.

In FIG. 4, the multiple guide cases (52) each has a plurality of guide waterways (520) defined therein. The guide waterways (520) communicate with two vane cases (51) adjacent to the guide case (52).

The detail structure of the vane case (51) is shown particularly in FIGS. 5 and 6. The vane case (51) is composed of an upper plate (510), a lower plate (512) respectively combined with the upper plate (510), and each combined pair of upper and lower plates (510, 512) has a plurality of vane segments (60) sandwiched therebetween.

The upper plate (510) is a round plate having a hole (5101) defined in the center. The axle tube (540) (see FIG. 3) penetrates and drivingly engages each upper plate (510) via mating with the hole (5101) of the upper plate (510). The lower plate (512) is a round plate corresponding to the upper plate (510) and an aperture (not shown) is defined in the center of the lower plate (512). The aperture has a larger diameter than a maximum diameter of the axle tube (540) to allow water to flow into the vane segments (60). The plurality of vane segments (60) has an inner wing (62) and an outer wing (64) extending outwardly and laterally from a respective side of the vane segment (60). The inner wing (62) is mated with the outer wing (64) of an adjacent segment. Each wing has two positioning holes (66) respectively defined in two ends thereof.

In assembly, multiple vane segments (60) are gathered to form a round combination and sandwiched between the upper plate (510) and the lower plate (512). The round combination is combined to both the upper and lower plates (510, 512) at the positioning holes (66).

Now referring to FIG. 4 again, when the motor operates, the axle tube (540) drives the multiple vane cases (51) to rotate to cause a centrifugal force to water therein. Therefore, the water inside the vane cases (51) starts to be expelled by the centrifugal force and the water outside the vane cases (51) is filtrated by the filter (54) and attracted into the multiple vane cases (51) via the aperture of the lower plate (512). The rotating multiple vane cases (51) cause a centrifugal force to the water so as to make the water travel spirally along the channels made of the vane segments (60) and be expelled from the vane cases (51).

When the water is expelled from the vane cases (51), the guide waterways (520) of the guide cases (52) receive the expelled water and spirally guide the water up to another of the upper vane cases (51). Therefore, the water is pumped up gradually to reach the water pipe (35) when the axle tube (330) rotates fast enough, and then the water is pumped from the well.

However, two drawbacks exist in this conventional water pump which are that a punching process is needed to form the positioning holes (66) and this causes extra work to produce the vane case (51). Additionally, fixing the vane segment (60) on the upper plate (510) and the lower plate (512) by the position holes (66) one by one is troublesome due to the necessary alignment of the corresponding holes of both plates (510, 512).

In order to make the water pump endurable and have more efficiency, the present invention has arisen to mitigate and/or obviate the disadvantages of the conventional vane cases.

SUMMARY OF THF INVENTION

The main objective of the present invention is to provide a spiral fluted wheel for a water pump that can be combined rapidly and precisely.

Further benefits and advantages of the present invention will become apparent after a careful reading of the detailed description with appropriate reference to the accompanying drawings.

DETAILED DESCRIPTION OF THE INVENTION

Figure 1:
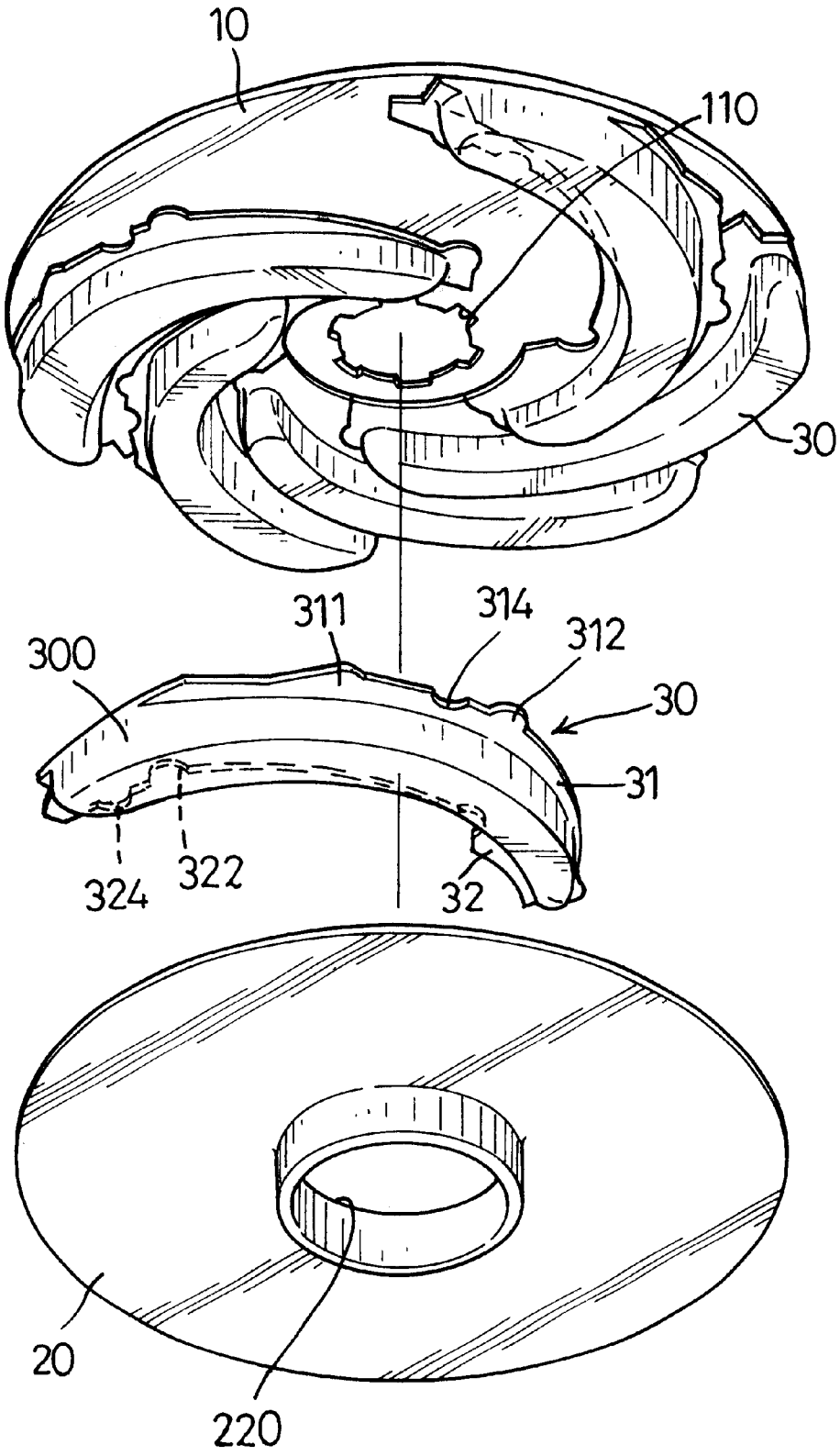
FIG. 1 is an exploded perspective view of a spiral fluted wheel for a water pump in accordance with the present invention.

With reference to FIG. 1, a spiral fluted wheel for a water pump in accordance with the present invention comprises a first plate (10), a second plate (20), and multiple spiral impellers (30).

The first plate (10) of the spiral fluted wheel is a round plate and a lock hole (110) is defined in the center of the first plate (10). The lock hole (110) is adapted to be firmly secured on an axle tube of the water pump to make the spiral fluted wheel rotate with the axle tube when the axle tube rotates.

The second plate (20) of the spiral fluted wheel is a round plate the same size as the first plate (10) and an inlet aperture (220) is defined in the center of the second plate (20). The inlet aperture (220) has larger diameter than a diameter of the axle tube to leave some space between the second plate (20) and the axle tube for entry of water into the spiral fluted wheel.

The multiple spiral impeller (30) are combined together to form a sandwich layer with a plurality of channels between the first plate (10) and the second plate (20).

Figure 2:
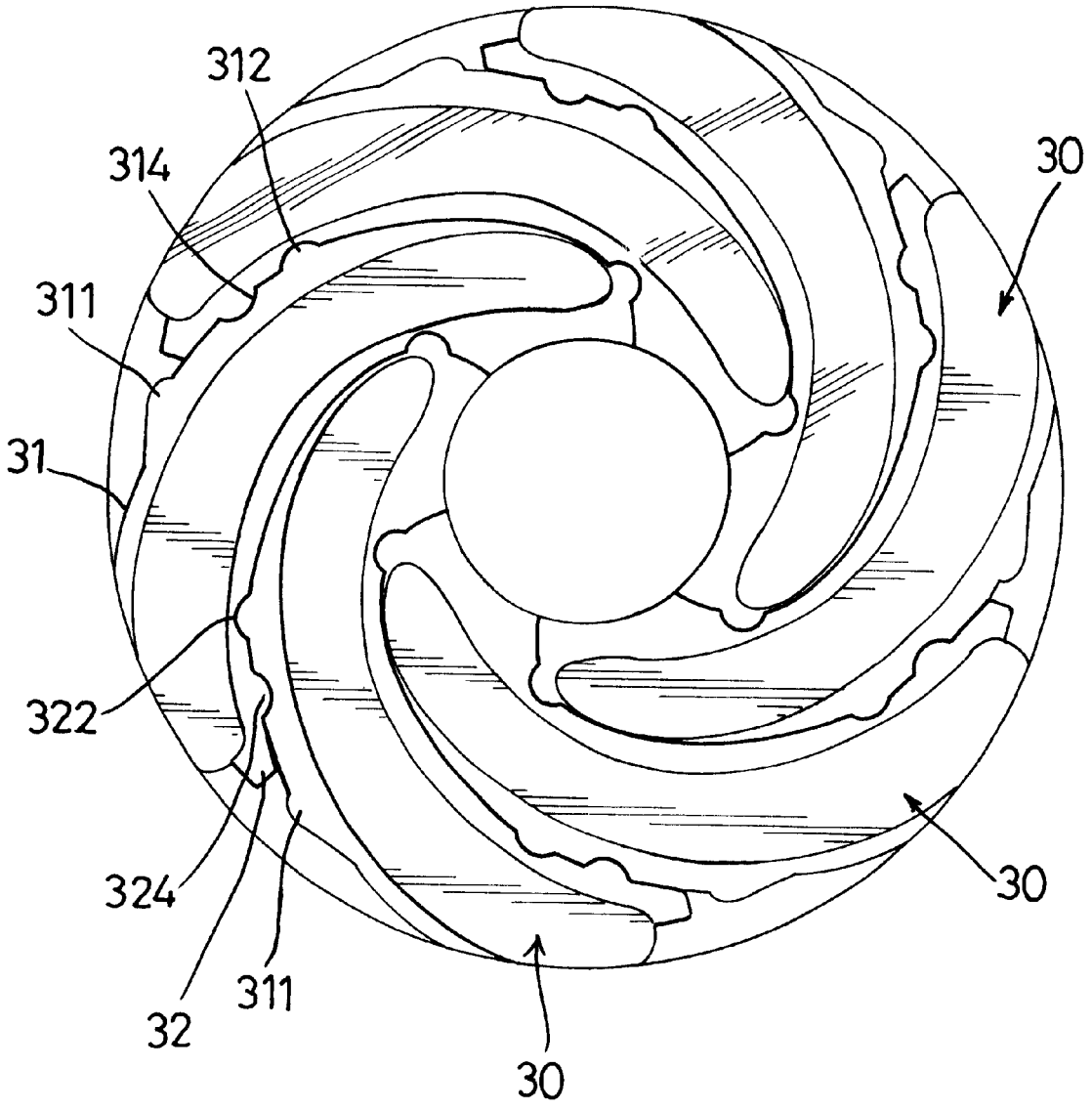
FIG. 2 is a top cross-sectional view of the spiral fluted wheel for a water pump in assembly in accordance with FIG. 1.
Figure 3:
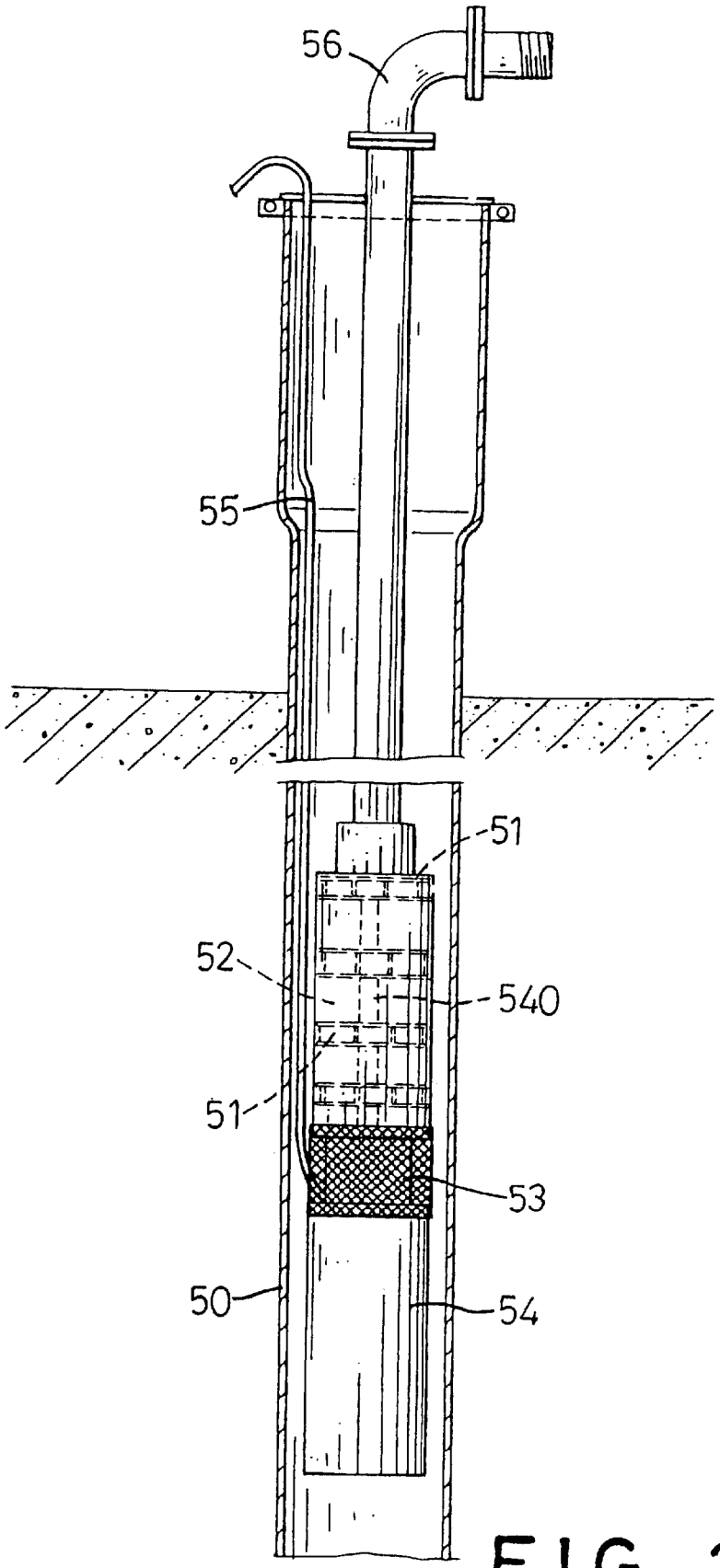
FIG. 3 is a partially cross-sectional side view of a water pump with multiple conventional vane cases.
Figure 4:
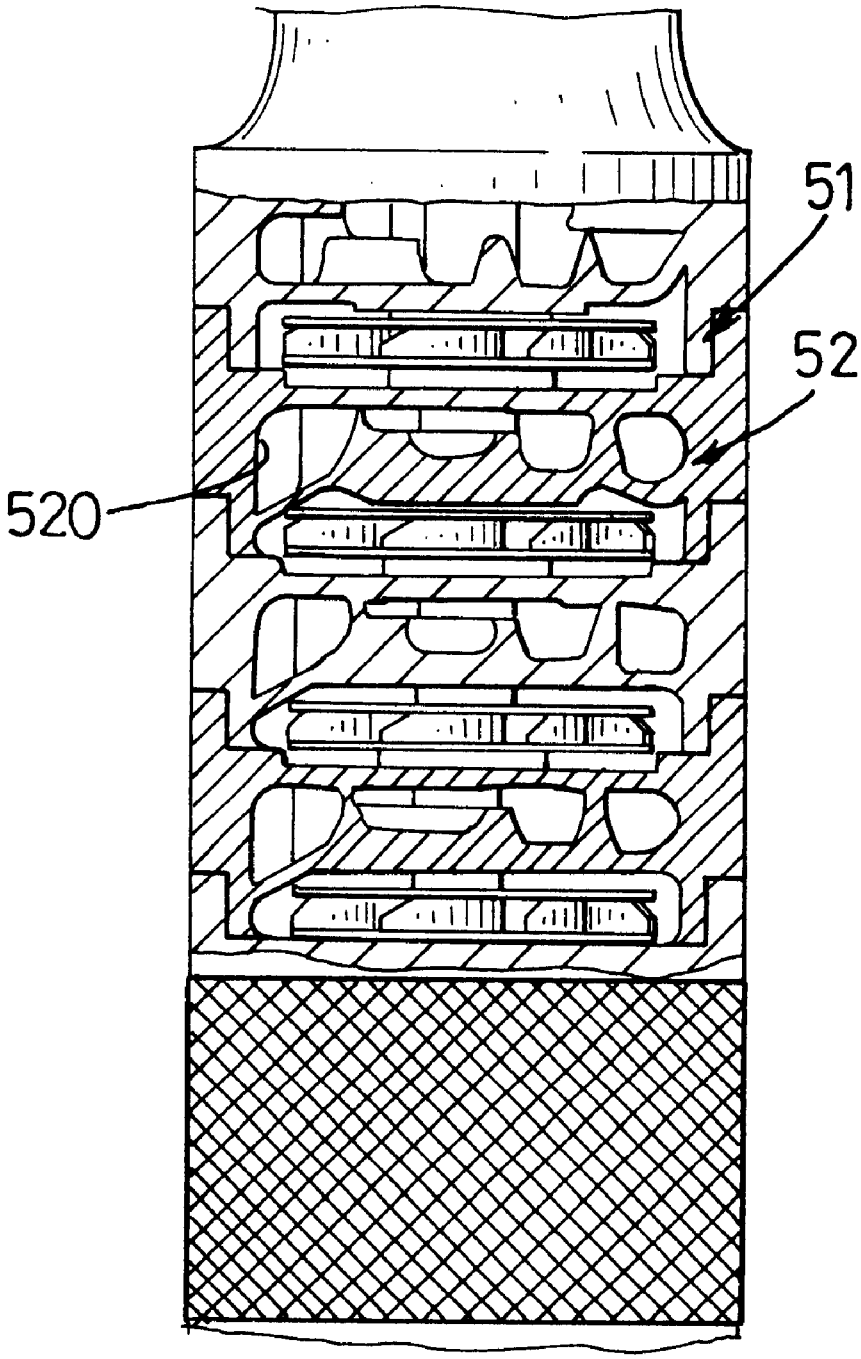
FIG. 4 is a side cross-sectional view of the vane cases and the guide cases in combination.
Figure 5:
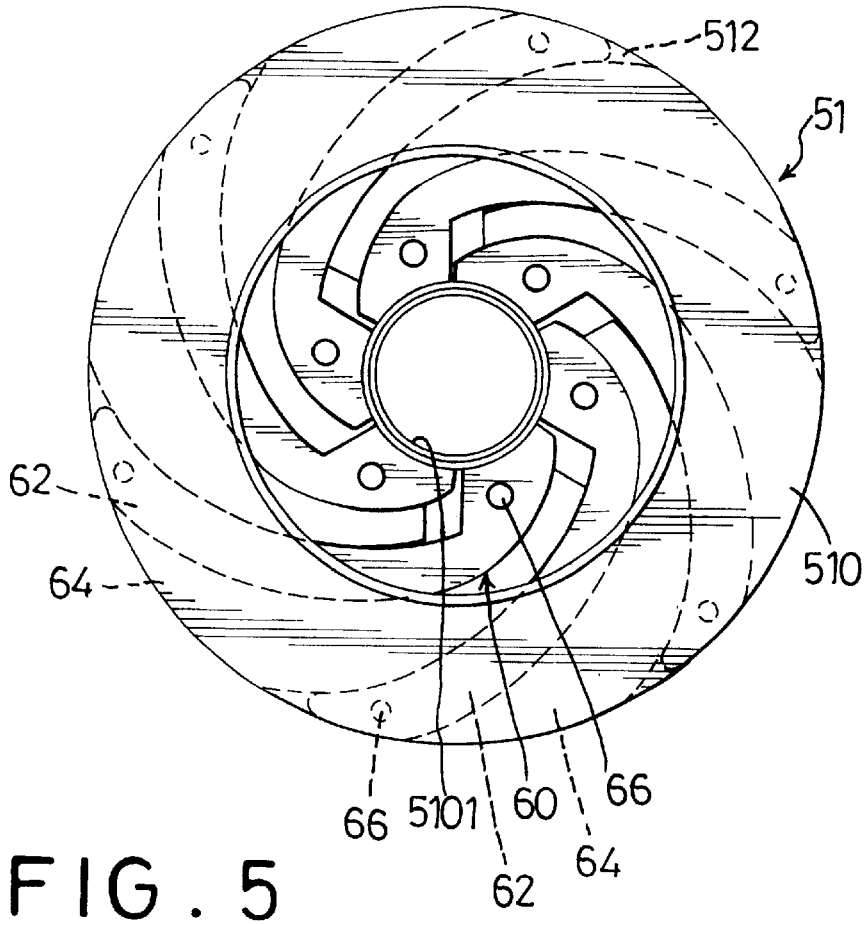
FIG. 5 PRIOR ART
FIG. 5 is a bottom cross-sectional view of the conventional vane case in assembly.
Figure 6:
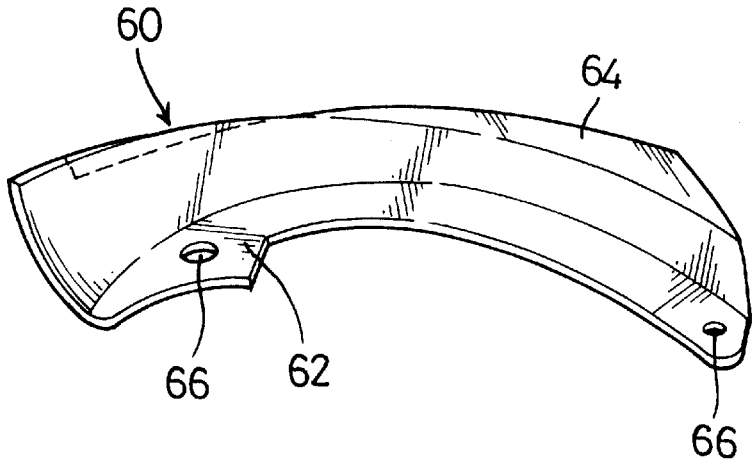
FIG. 6 PRIOR ART
FIG. 6 is a perspective view of one vane segment of the conventional vane case.

In FIGS. 1 and 2, each spiral impeller (30) is partially spiral-shaped and a spiral channel (300) is defined in a middle portion of the spiral impeller (30). The spiral impeller (30) has a flat bottom and two opposite thin side-walls erected on the flat bottom to construct and surround the spiral channel (300). Additionally, the spiral impeller (30) has a first flange (31) and a second flange (32) both extending laterally and outwardly from a top of the respective side wall. Width and shape of the spiral channel (300) is decided by the rotating speed of the water pump.

The first flange (31) has an outer convex portion (311) and an inner convex portion (312) protruding outwardly and a concave portion (314) defined in a middle edge of the first flange (31). The second flange (32) has an inner concave (322) and a convex portion (324) corresponding to the inner convex portion (312) and the concave portion (314) of the first flange (31) respectively, i.e. the first flange (31) is complementary to the second flange (32).

Therefore, the spiral impellers (30) are assembled to form the vane layer between the first plate (10) and the second plate (20). A required quantity of the spiral impellers (30) are combined to compose a round combination by piecing the first flange (31) to the second flange (32) of the adjacent spiral impeller (30) together. The convex portions and the concave portions of both flanges make the combination of vane layer precise and easy, because of the planned shape of the complementary flanges (31, 32).

Then, the flat bottom of the spiral impeller (30) is welded to an upper face of the second plate (20) and top faces of the combined flanges (31, 32) are welded to a bottom face of the first plate (10) to form the vane layer between the first plate (10) and the second plate (20).

According to the above description, several advantages are discovered and listed as following:

1. Fast Combination:

Because the planned convex and concave portions of the first flange (31) correspond to the ones of the second flange (32), the combination of the vane layer is easy and fast.

2. Precise Combination:

The planned flanges (31, 32) and designed spiral channel (300) make the vane layer precise and normalized in structure so that water travels through the spiral channels (300) fluently. Besides, manufacturers do not need any extra means, such as the positioning holes in the conventional vane to compose the spiral fluted wheel precisely.

Although the invention has been explained in relation to its preferred embodiment, it is to be understood that many other possible modifications and variations can be made without departing from the spirit and scope of the invention as hereinafter claimed.

What is claimed is:

1. A spiral fluted wheel for a water pump, and the spiral fluted wheel comprising:

a first plate (10) having a lock hole (110) defined in a center of the first plate (10), and a periphery defining the lock hole (110) adapted to be firmly secured on a rotating device;

a second plate (20) corresponding to the first plate (10) and having an inlet aperture (220) defined in a center of the second plate (20) for entry of water into the spiral fluted wheel; and multiple individual spiral impellers (30) sandwiched between the first plate (10) and the second plate (20), each spiral impeller (30) having a spiral channel (300) defined thereby and two flanges (31, 32) laterally extending and complementary engaged to another flange of an adjacent spiral impeller (30), whereby when the spiral fluted wheel rotates and water travels into the spiral fluted wheel via the inlet aperture and is centrifugally driven outwardly along the spiral channels (300).

2. The spiral fluted wheel for a water pump as claimed in claim 1, wherein each spiral impeller (30) having:

a first flange (31) having an outer convex portion (311) and an inner convex portion (312) protruding outwardly, and a concave portion (314) defined in a middle edge of the first flange (31);

a second flange (32) has an inner concave (322) and a convex portion (324) corresponding to the inner convex portion (312) and the concave portion (314) of the first flange (31) respectively.

3. The spiral fluted wheel for a water pump as claimed in claim 1, wherein the spiral channel (330) of the spiral impeller (30) is U-shaped.

4. The spiral fluted wheel for a water pump as claimed in claim 2, wherein the spiral channel (330) of the spiral impeller (30) is U-shaped.

* * * * *